US007507115B2

(12) United States Patent
Ju

(10) Patent No.: US 7,507,115 B2
(45) Date of Patent: Mar. 24, 2009

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/542,114

(22) Filed: Oct. 4, 2006

(65) Prior Publication Data

US 2008/0085628 A1 Apr. 10, 2008

(51) Int. Cl.
*H01R 13/60* (2006.01)

(52) U.S. Cl. ..... 439/541.5

(58) Field of Classification Search ..... 439/541.5, 439/79, 63, 55

See application file for complete search history.

(56) References Cited

U.S. PATENT DOCUMENTS 6,666,716 B2 * 12/2003 Chien-Chung ..... 439/541.5
6,887,099 B1 * 5/2005 Tung ..... 439/541.5
7,008,261 B2 * 3/2006 Xue et al. ..... 439/541.5
2004/0259414 A1 * 12/2004 Shih ..... 439/541.5

FOREIGN PATENT DOCUMENTS

TW 545773 8/2003

* cited by examiner

*Primary Examiner*—Alexander Gilman
(74) *Attorney, Agent, or Firm*—Rosenberg, Klein & Lee

(57) ABSTRACT

An electrical connector includes an insulating body, and at least four pins receiving in the insulating body, such as a first pin, a second pin, a third pin, and a fourth pin. The height of the first pin and second pin is higher than the third pin or fourth pin. The pin has a connecting arm. A flexible arm extends from one end of the connecting arm. The connecting arms are located on the same plane, and the flexible arms are not all located on the same plane. The electrical connector further includes eight pins. Because the height of the bent pins is different from each other and the connecting arms are located on the same plane, the shape of the pins can be versatile and the entire pin's structure is simple. Manufacturing efficiency is thereby increased, manufacturing costs reduced, and the assembly quality is enhanced.

19 Claims, 5 Drawing Sheets

ELECTRICAL CONNECTOR

BACKGROUND OF THE INVENTION

1. Field of the Invention

The present invention relates to an electrical connector. In particular, this invention relates to a sound-socket electrical connector.

2. Description of the Related Art

As electronic products and multi-medium personal computers have developed, sound-socket electrical connectors have become popularly applied to them both. As users desire to have high performance electronic devices, the requirements for and performances of sound-socket electrical connector have become higher and higher.

Current sound-socket electrical connectors usually include four signal-pins and a grounding-pin. The structure of the grounding-pin is simple and easily manufactured. The sound-socket electrical connector is usually a stacked-type. For example, a sound-socket electrical connector having three stacked plugging interfaces has three sets of signal-pins. Each of the signal-pins has four pins. The signal-pins are arranged from up to down and the height of the bent pins are different from each other. Each of the pins is formed individually. Therefore, each of the pins is respectively plugged into the pin-receiving ditch.

Taiwan patent TW 545773 discloses a triple sound-socket electrical connector. The triple sound-socket electrical connector includes a base, a glue core, and five pin sets plugged in the base and the glue core. The third pin set is a grounding-pin and the others are signal-pins. Each of the pin sets includes three pins that need to be individually plugged into the corresponding through hole and the plugging-ditch in the base and the glue core. Each of the pins needs to be manufactured individually and have a complex structure. Furthermore, each of the pins needs to be plugged into a corresponding through hole and a plugging-ditch. It is difficult to manufacture the pins and the cost of the pins is high.

SUMMARY OF THE INVENTION

One particular aspect of the present invention is to provide an electrical connector in which the structure of its pins is simple.

A further particular aspect of the present invention is to provide an electrical connector whose pins can be assembled easily and the manufacturing efficiency is increased.

The electrical connector includes an insulating body, and at least four pins received in the insulating body, such as the first pin, the second pin, the third pin, and the fourth pin. The height of the first pin and the second pin are higher than the third pin or the fourth pin. The pin has a connecting arm. A flexible arm extends from one end of the connecting arm. The connecting arms are located on the same plane, and the flexible arms are not all located on the same plane. The electrical connector further includes eight pins. Four pins belong to one set, and the pins are divided into three sets.

The present invention has the following merits. Because the height of the bent pins is different from each other and the connecting arms are located on the same plane, the shape of the pins is versatile and the entire pin's structure is simple. It is easy to assemble the pins, so the manufacturing efficiency increases, the manufacturing costs are reduced, and the assembly quality is enhanced.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
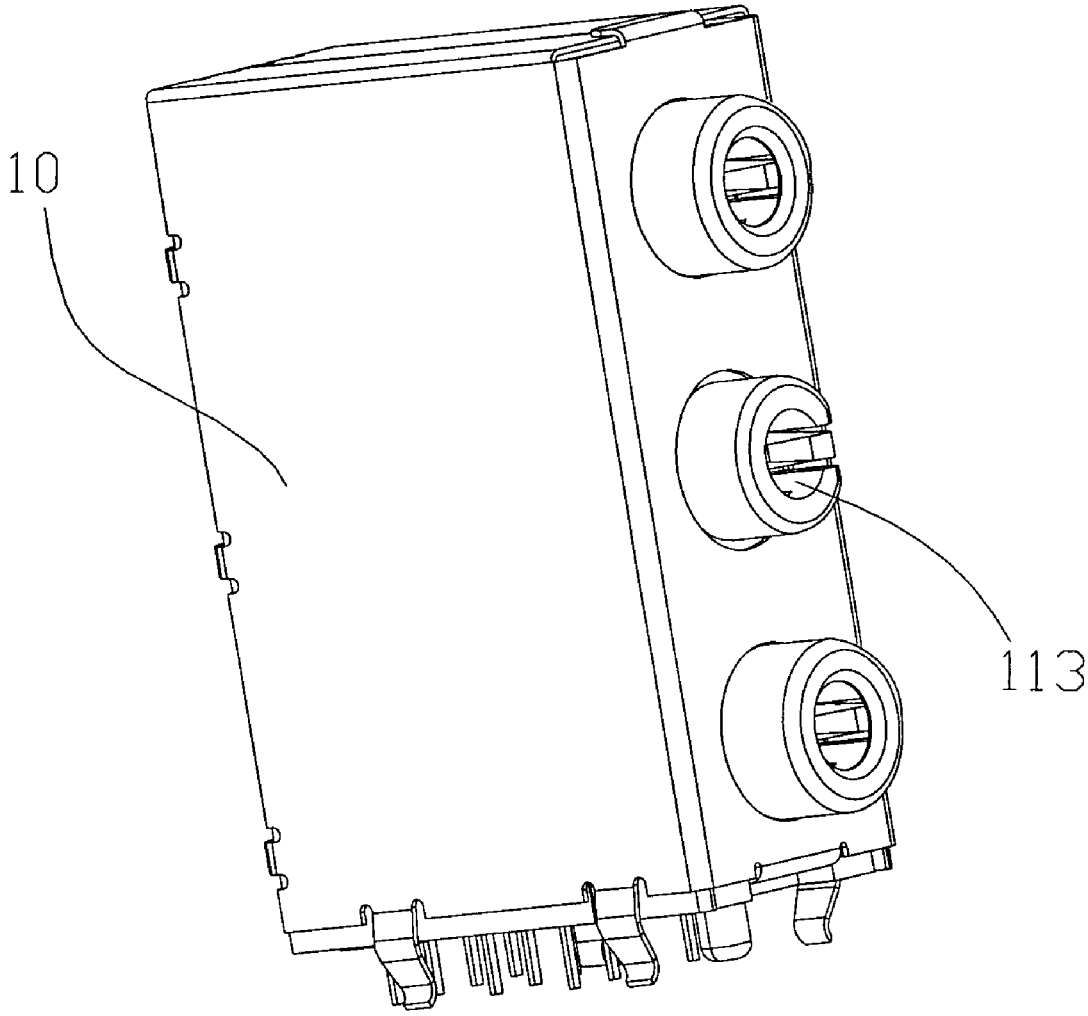
FIG. 1 is an assembly perspective view of the electrical connector of the present invention.
Figure 2:
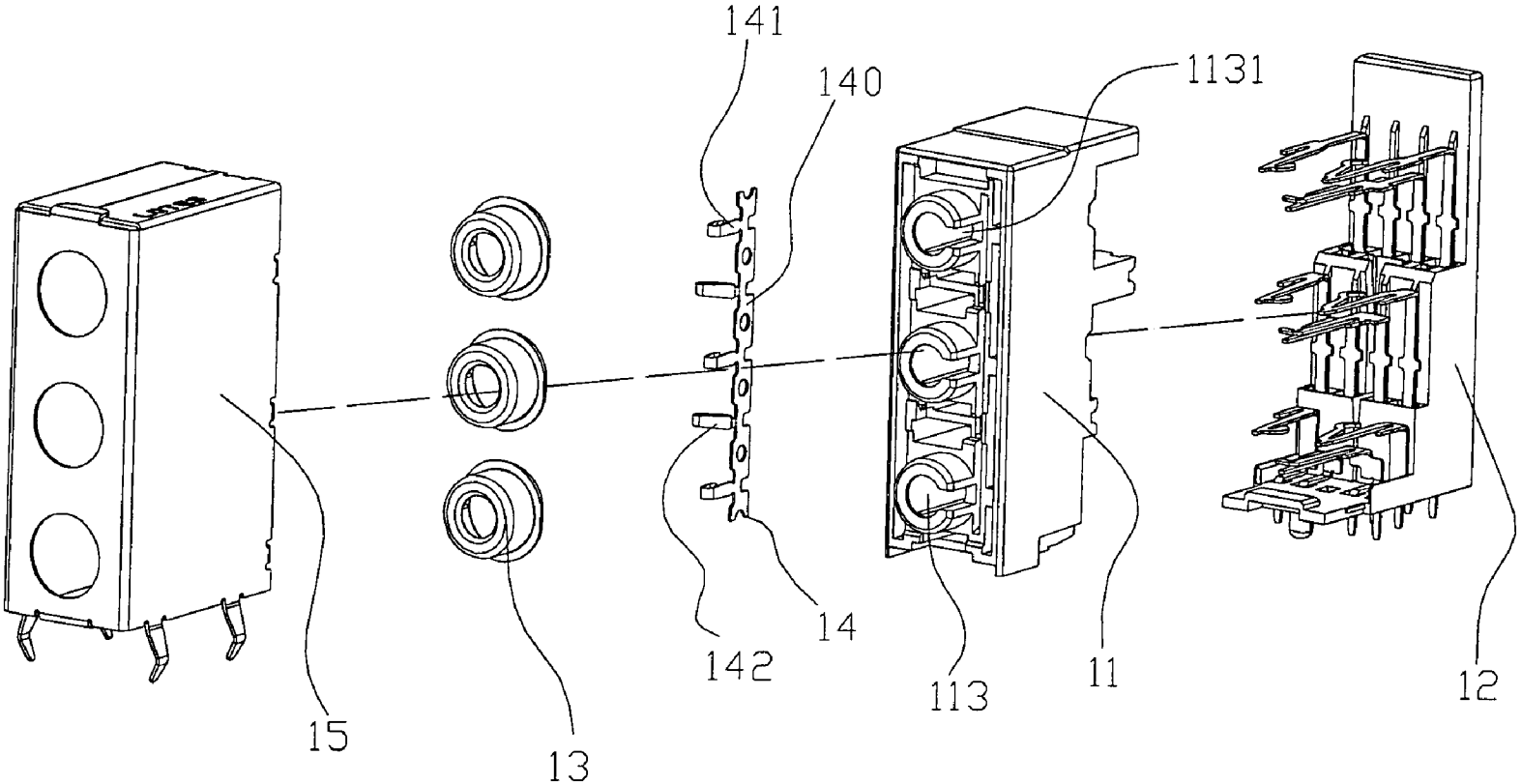
FIG. 2 is an exploded perspective view of the electrical connector of FIG. 1.
Figure 3:
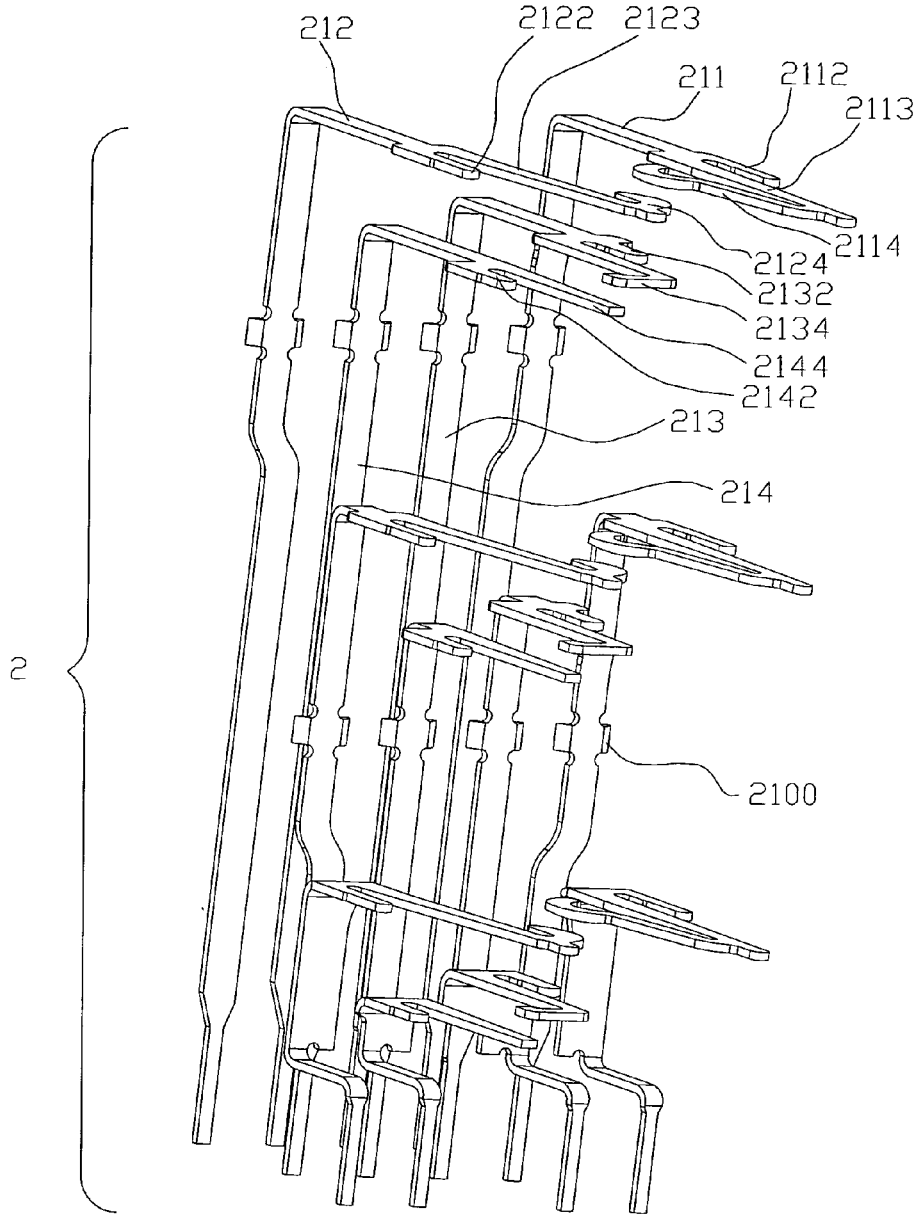
FIG. 3 is a schematic diagram of the pin of the electrical connector of FIG. 1.
Figure 6:
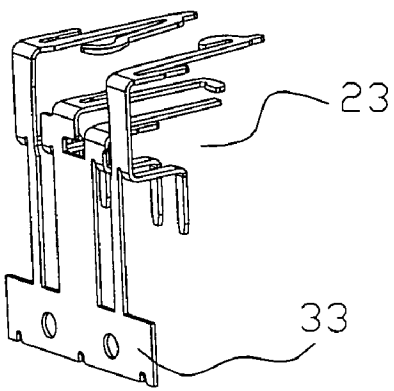
FIG. 6 is a schematic diagram of the lower row pins connected with the pin material belt of FIG. 3.
Figure 5:
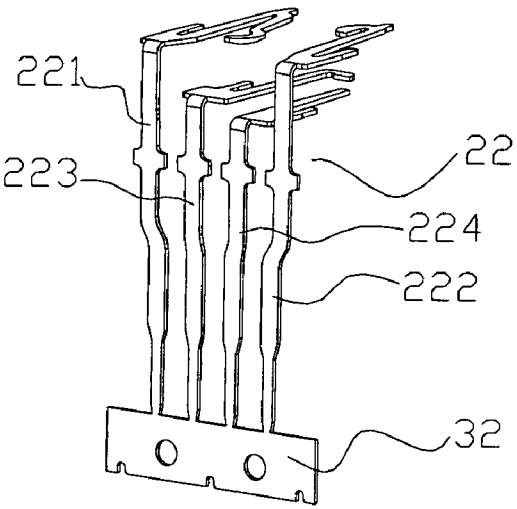
FIG. 5 is a schematic diagram of the middle row pins connected with the pin material belt of FIG. 3.
Figure 4:
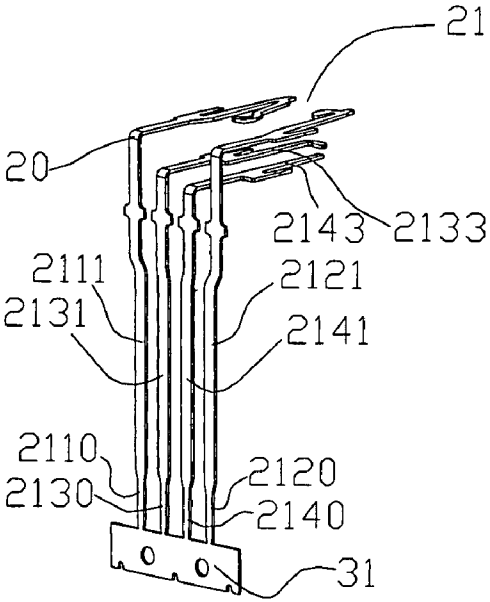
FIG. 4 is a schematic diagram of the upper row pins connected with the pin material belt of FIG. 3.
Figure 9:
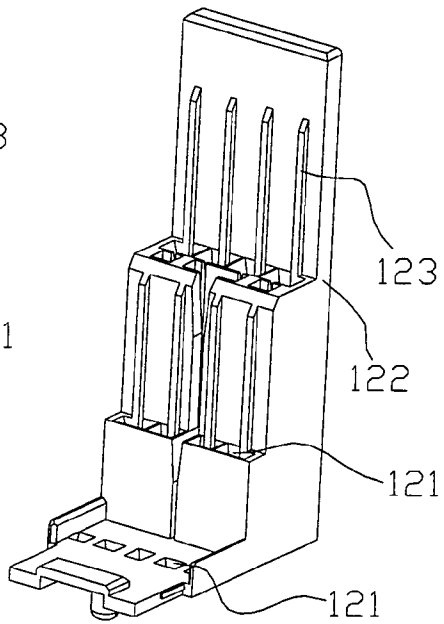
FIG. 9 is a schematic diagram of the rear stopper of FIG. 2.
Figure 8:
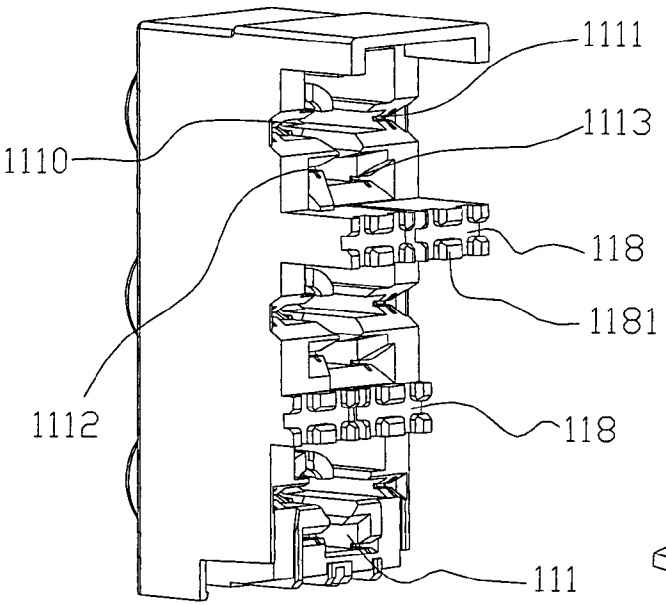
FIG. 8 is another schematic diagram of the main body of FIG. 7.
Figure 7:
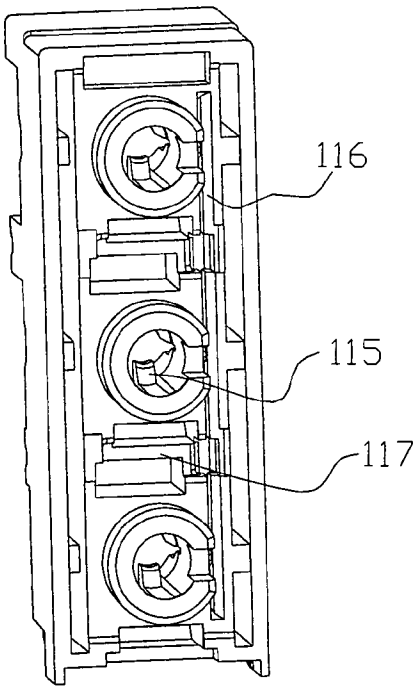
FIG. 7 is a schematic diagram of the main body of FIG. 2.

Reference is made to FIGS. 1-9. The electrical connector 10 is a sound-socket electrical connector, and is connected with an electronic element (not shown in the figure) to transmit the sound signal. The electrical connector 10 includes a main body 11, a rear stopper 12, a covering ring 13, three rows or three sets of pins 2 that are disposed in upper, middle, and lower rows and each of the rows has at least four pins, a grounding flake 14 having a plurality of grounding-pins, and a sheltering shell 15 covering an outside of the main body 11 and the rear stopper 12. The sheltering shell 15 is a metallic shell which provides a sheltering function.

On the front surface of the main body 11, there are three plugging holes 113. In the plugging hole 113, there is a plastic arm 115 that is integrated into one piece with the main body 11. At the side edge of the plugging hole 113, there is a concave trench 1131. There are two concave gaps 117 between the plugging holes 113 in the vertical direction and they are both disposed at a distance. On the front surface of the main body 11 that is adjacent to the plugging hole 113, there is a grounding flake receiving slot 116 for receiving the grounding flake 14. On the rear surface of the main body 11, there are three rows of pin-receiving slots 111 that are disposed on upper, middle, and lower rows. Each row of the pin-receiving slots 111 has four receiving slots 1110, 1111, 1112, and 1113 that respectively receives one pin from the set of pins. A protruding part 118 extends backwards from the adjacent sets of pin-receiving slots 111 on the rear surface of the main body 11. There are two protruding parts 118 on the rear surface of the main body 11. The length of the upper protruding part 118 extending away from the main body 11 is larger than the length of the lower protruding part 118. On the protruding part 118, there are four sets of fastening points 1181 for fastening the pins 2 located on the upper row and the lower row. The rear stopper 12 also has three rows of pin-receiving holes 121, and there is a step wall on the body of the rear stopper 12. The pin-receiving holes 121 are respectively located on the step wall 112. On the locations of the step wall 112 that correspond to the pin-receiving holes 121 along the vertical direction, there is a protruding part that can position the connecting arms of the upper row of pins and the middle row of pins. In this embodiment, the protruding part is a rib strip 123. The grounding flake 14 is received in the grounding flake receiving slot 116 of the main body 11. The grounding flake 14 includes a main body 140 and a plurality of grounding-pins located on the main body 140, including three first grounding-pins 141 and two second grounding-pins 142. The first grounding-pins 141 are installed in the concave trench 1131 and contact the electronic element (not shown in the figure). The second grounding-pins 142 are installed in the concave gaps 117 and conduct signals to the sheltering shell 15. Alternatively, the main body 140 conducts signals to the sheltering shell 15 so as to connect with the grounding.

The set of pins 2 includes sound pins and signal pins. This means that the sound pins and the signal pins are integrated into one piece on the pin material belt. The upper row of the sound pins and the signal pins 21 are integrated into one piece on the pin material belt 31. The middle row of the sound pins and the signal pins 22 are integrated into one piece on the pin material belt 32. The lower row of the sound pins and the signal pins 23 are integrated into one piece on the pin material belt 33. Four pins on the pin material belt form a set of pins, including the first pin, the second pin, the third pin, and the fourth pin. The shape of the four pins are different from each other. The two sound pins are located on two sides of the pin material belt. The first pin and the second pin are the sound pins. The signal pins are located in middle of the pin material belt. The third pin and the fourth pin are the signal pins.

The pin material belt 31 is taken as an example. There are four pins that are integrated with the pin material belt 31 into one piece and form one set of upper row sound pins and signal pins 21. Because the sound pins are located on the outside of the signal pins, the four pins from right to left are respectively the first pin 211, the third pin 213, the fourth pin 214, and the second pin 212. The four pins 211, 212, 213, 214 respectively have connecting parts 2110, 2120, 2130, 2140 that are connected with the pin material belt 31. Connecting arms 2111, 2121, 2131, 2141 extend from the upper end of the connecting part, and the front ends of the connecting arms 2111, 2121, 2131, 2141 open to form fastening arms 2112, 2122, 2132, 2142 and flexible arms 2113, 2123, 2133, 2143. At the middle of the connecting arm, a fastening flake 2100 extends from two sides of the connecting arm. The connecting arm located between the fastening flake 2100 and the connecting part, the connecting arms of the first pin, and the third pin all have a "⌐" shape in the vertical plane, and the connecting arms of the second pin and the fourth pin all have an "inverse ⌐" shape in the vertical plane that corresponds to the connecting arms of the first pin and the third pin. Therefore, the space occupied by the pins is small and the pins are disposed close together. An included angle or an opening is formed between the connecting arms 2111, 2121, 2131, 2141 and the flexible arms 2113, 2123, 2133, 2143. The flexible arms 2113, 2123, 2133, 2143 extend to form contacting parts 2114, 2124, 2134, 2144 (the contacting parts 2134, 2144 of the signal pins 213, 214 can also be called a third contacting part 2134, and a fourth contacting part 2144). The contacting part 2114 of the first pin and the contacting part 2124 of the second pin respectively face towards the inside of the set of pins, are bent inwards, and correspond to each other. The contacting part 2134 of the third pin faces downwards, and extends to the fourth pin and engages to the upper side of the fourth pin. The contacting part 2144 of the fourth pin faces upwards and corresponds to the contacting part 2134 of the third pin. The locations of the fastening arms 2112, 2122 of the sound pins 211, 212 are opposite to the locations of the flexible arms 2113, 2123. This means that the fastening arm 2113 of the first pin 211 and the fastening arm 2123 of the second pin 212 are respectively located on the opposite outsides of the pin, and the contacting parts 2114, 2124 are formed by bending the flexible arms 2113, 2123. However, the shape of the contacting parts 2114 is different from the shape of the contacting parts 2124. Therefore, the structure of the sound pin 211 is different from the structure of the sound pin 212. The locations of the fastening arms 2132, 2142 of the signal pins 213, 214 are opposite to the locations of the flexible arms 2133, 2143. This means that the flexible arm 2113 of the first pin 211 is adjacent to the fastening arm 2132 of the third pin 213, the flexible arm 2133 of the third pin 213 is adjacent to the flexible arm 2143 of the fourth pin 214, and the fastening arm 2142 of the fourth pin 214 is adjacent to the flexible arm 2123 of the second pin 212. The third contacting part 2134 of the third pin 213 is also formed by bending the flexible arm 2133 and has a hook shape. However, the shape of the third contacting part 2134 is different from the shape of the contacting parts 2114, 2124 of the sound pins 211, 212. The fourth contacting part 2144 of the fourth pin 214 is located on an end of the flexible arm 2143. Therefore, the structure of the signal pin 213 is different from the structure of the signal pin 214, and the structure of the sound pins 211, 212 are also different from the structure of the signal pins 213, 214.

After the pins are formed, the pins are bent so that there is at least one bending point 20 on the pins. The connecting arms 2111, 2121, 2131, 2141 of the bent pin 21 forms a "⌐" shape. The fastening flake 2100 is located on the vertical part of the connecting arm. The vertical parts of the connecting arms of the pin set having four pins are located on the same plane. The horizontal parts of the connecting arms are not located on the same plane. The connecting parts 2110, 2120, 2130, 2140 of the upper row pin set are also located on the same plane. The plane for the connecting arms and the plane for the connecting part are the same plane. The height of the bending points of the sound pins 211, 212 are higher than the height of the bending points of the signal pins 213, 214. The heights of the bending points of the sound pins 211, 212 located on the two ends of the pin material belt are equal. The heights of the bending points of the signal pins 213, 214 located in the middle of the pin material belt are unequal. Therefore, the horizontal heights of the flexible arms are different from each other. The height of the bending point of the third pin 213 is higher than the height of the bending point of the fourth pin 214. Therefore, the third contacting part 2134 of the third pin 213 is located above the fourth contacting part 2144 of the fourth pin 214. When the electronic element (not shown in the figure) is plugged into the electrical connector 10, the electronic element pushes and contacts the plastic arm 115 so that the plastic arm 115 is compressed downwards to contact the third pin 213. Thereby, the third contacting part 2134 of the third pin 213 compresses the fourth contacting part 2144 of the fourth pin 214 downwards to make the signal pins conduct. At this time, the electronic element conducts the sound pins—the first pin 211 and the second pin 212.

Similarly, the sound pins and the signal pins 22 of the middle row are also integrated with the pin material belt into one piece. The middle row pins include the other first pin 221 and the other second pin 222 located on two sides of the pin material belt 32, and the other third pin 223 and the other fourth pin 224 located in the middle of the pin material belt 32. The structure of the four pins 22 of the middle row is the same as one of the four pins 21 of the upper row, except that the four pins 22 of the middle row are smaller than the four pins 21 of the upper row.

Similarly, the sound pins and the signal pins 23 of the lower row are also integrated with the pin material belt into one piece. The structure of the four pins 23 of the middle row is the same as one of the four pins 21 of the upper row, except that the four pins 22 of the middle row are the smallest, the connecting arm and the welding arm of the pin 23 are bent into a cubic "ㄱ" shape, and the connecting parts and the vertical part of the connecting arm of the pins 23 are not located on the same plane.

When the pins are assembled, the pins 21, 22, 23 connected on the pin material belts 31, 32, 33 are respectively plugged into the corresponding pin-receiving slots 111 to make the fastening flake of the pin fit with the protruding part 118. The fastening flake 2100 of the pin fits with the fastening point 1181 of the protruding part 118 to fasten the pins 21, 22. Next, the pin material belts 31, 32, 33 are broken. The lower end of the connecting arm and the connecting part of the pin are plugged into the corresponding pin-receiving slot 121. The pins 21, 22 sequentially contact and push the rib strips 123. Thereby, the pins 21, 22 are firmly plugged into electrical connector 10. Because the pins 23 are different from the pins 21, 22, including the connecting parts and the connecting arms are not located on the same plane, and the structure is the smallest, the pins 23 are received in the receiving slots 1110, 1111, 1112, 1113 and are fastened by the pin-receiving holes 121 of the rear stopper 12.

Because the pins are directly connected with the pin material belts before they are bent and part of the connecting arms and the connecting parts of the bent pins are located on the same plane, and the flexible arms are not located on the same plane, and the height of the flexible arms are different from each other, the shape of the pins are versatile. Furthermore, the pin includes the connecting part and the contacting part so that the structure of the pin is simple. The pins are integrated with the pin material belt into one piece. It is easy to assemble the pins, the manufacturing efficiency increases, the manufacturing cost is reduced, and the assembly quality is enhanced.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. An electrical connector, comprising:

an insulating body having at least one plugging hole correspondingly connecting with an electronic element; and at least one set of pins received in the same plugging hole, wherein said set of pins includes a first pin, a second pin, a third pin, and a fourth pin;

wherein the height of the first pin and the second pin is higher than the height of the third pin or the fourth pin, each pin has a connecting arm and a flexible arm extending from one end of the connecting arm, part of the connecting arms are located on a same plane, and the flexible arms are not all located on the same plane.

2. The electrical connector as claimed in claim 1, wherein the connecting arms are respectively comprised of at least one bending point, the height of the bending points are different, and the connecting arms are bent to form flexible arms having different horizontal heights.

3. The electrical connector as claimed in claim 1, wherein the connecting arm of the pins extends to form a contacting part and a fastening part.

4. The electrical connector as claimed in claim 3, wherein the contacting parts of the first pin and the second pin face inwards.

5. The electrical connector as claimed in claim 1, wherein the flexible arm of the third pin extends to form a contacting part, and the contacting part extends to the fourth pin and is located above the fourth pin.

6. The electrical connector as claimed in claim 1, wherein the insulating body includes a plastic arm contacting the electronic element so that the electronic element is compressed to make the third pin conduct the fourth pin.

7. The electrical connector as claimed in claim 1, wherein the third pin and the fourth pins are located between the first pin and the second pin.

8. The electrical connector as claimed in claim 1, wherein the connecting arm of the first pin has a "ㄱ" shape, and the connecting arm of the second pin has an "inverse-ㄱ" shape.

9. The electrical connector as claimed in claim 1, further comprising a plurality of grounding flakes conducting with the electronic element.

10. The electrical connector as claimed in claim 1, wherein the electrical connector is a sound-socket electrical connector, and a metallic shell is located on an outside of the insulating body.

11. The electrical connector as claimed in claim 1, further comprising eight pins, four pins belonging to one set, and the pins are divided into three sets.

12. The electrical connector as claimed in claim 11, wherein at least three pins of the pins are bent inwards to form a contacting part.

13. The electrical connector as claimed in claim 11, wherein the connecting arms of the same set of the pins are located on the same plane.

14. The electrical connector as claimed in claim 11, wherein the each of the pins comprises a contacting part and a connecting part.

15. The electrical connector as claimed in claim 14, wherein the connecting parts of the same set of the pins are located on the same plane.

16. The electrical connector as claimed in claim 14, wherein the plane for the connecting arms and the plane for the connecting parts of at least one set of pins are not the located on the same plane.

17. The electrical connector as claimed in claim 11, further comprising a plurality of grounding flakes conducting with the electronic element.

18. The electrical connector as claimed in claim 11, further comprising a rear stopper, wherein the rear stopper has a protruding part for positioning the pins, the pin has a connecting arm, and the connecting arm contacts the protruding part.

19. The electrical connector as claimed in claim 18, wherein the rear stopper has a step wall, and the protruding part is a rib strip located on the step wall.

* * * * *